US006811436B2

(12) United States Patent
Tabata

(10) Patent No.: US 6,811,436 B2
(45) Date of Patent: Nov. 2, 2004

(54) MALE TERMINAL FITTING AND A CONNECTOR PROVIDED THEREWITH FOR ACHIEVING ACCURATE POSITIONING OF THE MALE TERMINAL FITTING

(75) Inventor: Masaaki Tabata, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/353,239

(22) Filed: Jan. 28, 2003

(65) Prior Publication Data

US 2003/0157832 A1 Aug. 21, 2003

(30) Foreign Application Priority Data

Feb. 15, 2002 (JP) ..... 2002-038902

(51) Int. Cl.[7] ..... H01R 13/40
(52) U.S. Cl. ..... 439/595; 439/884
(58) Field of Search ..... 439/595, 744, 439/871, 752.2, 884, 885

(56) References Cited

U.S. PATENT DOCUMENTS 4,019,799 A * 4/1977 Bouvier ..... 439/595
4,607,907 A * 8/1986 Bogursky ..... 439/682
4,889,501 A * 12/1989 Sato ..... 439/595

FOREIGN PATENT DOCUMENTS

JP 6-9073 2/1994

* cited by examiner

*Primary Examiner*—Javaid H. Nasri
(74) *Attorney, Agent, or Firm*—Gerald E. Hespos; Anthony J. Casella

(57) ABSTRACT

A connector has a housing (10) formed with cavities (11) for receiving male terminal fittings (40). Each cavity (11) has a receiving surface (16) substantially normal to an inserting direction of the male terminal fitting (40), and each male terminal fitting (40) has a contact surface (50) substantially normal to the inserting direction. The inserted male terminal fitting (40) is stopped at a front-limit position by bringing the contact surface (50) thereof into contact with the receiving surface (16) in the cavity (11) substantially in the same direction as the inserting direction of the male terminal fitting (40). Thus, the male terminal fitting (40) can be stopped at a proper insertion position.

8 Claims, 13 Drawing Sheets

MALE TERMINAL FITTING AND A CONNECTOR PROVIDED THEREWITH FOR ACHIEVING ACCURATE POSITIONING OF THE MALE TERMINAL FITTING

BACKGROUND OF THE INVENTION

1. Field of the Invention

The invention relates to a male terminal fitting and to a connector with such a fitting.

2. Description of the Related Art

Japanese Unexamined Utility Model Publication No. 6-9073 discloses a connector with a housing and with cavities formed in the housing. Male terminal fittings are inserted into the cavities from behind and are intended to be stopped at proper insertion positions so as not to move any further forward. Locks formed in the housing then lock the male terminal fittings. Each male terminal fitting includes a rectangular tube formed with a locking hole that engages the corresponding lock, and a tab that projects from the front end of the rectangular tube for connection with a female terminal fitting. An area of the front end surface of the rectangular tube near the tab serves as a front-stop that contacts a receiving surface at the front end of the cavity in an effort to stop the terminal fitting at the front-limit position.

The male terminal fitting described above is formed by bending a plate member stamped out into a specified shape. The front-stop at the front end of the rectangular tube is aligned oblique to an inserting direction of the male terminal fitting due to a bending process. Further, a clearance is defined between the inner walls of the cavity and the outer surfaces of the male terminal fitting in view of dimensional tolerances. Accordingly, the male terminal fitting shakes in directions intersecting the inserting direction in the cavity. Thus, the male terminal fitting may make loose forward movements and may obliquely displace along the inclination of the front-stop even if the front-stop engages the receiving surface.

The invention was developed in view of the above problem and an object thereof is to securely stop a male terminal fitting at its front-limit position.

SUMMARY OF THE INVENTION

The invention relates to a male terminal fitting that can be inserted along an inserting direction into a cavity formed in a housing. The male terminal fitting has a contact surface substantially normal to the inserting direction and is stopped at a proper insertion position by contact of the contact surface with a receiving surface in the cavity. Accordingly, the terminal fitting will not make loose forward movements because the receiving surface is substantially normal to the inserting direction and is not displaced along the contact surface. Thus, tolerances do not influence the operability of the terminal fitting and the male terminal fitting can be stopped at the specified position so as not to move further forward.

The male terminal fitting preferably has an intermediate portion formed as a substantially rectangular tube and a front portion formed as a tab. A coupling portion with a tapered or converging shape preferably is formed at the front end of the substantially rectangular tube and is continuous with the base end of the tab. An overlay plate preferably is placed substantially on the outer surface of the coupling portion and includes the contact surface.

The coupling portion is formed into the tapered shape by a press and hence is potentially weak. However, the overlay plate reinforces the coupling portion. The outer edge of the contact surface is a sharp edge, and is located at the front end of the tapered coupling portion. However, the outer edge of the contact surface is more inward than the outer surface of the rectangular tube. Accordingly, the outer edge of the contact surface does not damage inner wall portions (for example, a sealing surface to be brought into close contact with a waterproof rubber plug in the case of a watertight connector, a resin lock provided along the inner wall of the cavity to lock the male terminal fitting) during insertion of the male terminal fitting.

A part of a wall that forms the substantially rectangular tube preferably has a double-plate structure with an inner plate and an outer plate placed over the inner plate. The overlay plate extends integrally or unitarily from the front of the outer plate. Thus, a boundary between the overlay plate and the outer plate at the front end of the rectangular tube is a relatively smooth and has no sharp edge. Accordingly, the front end of the rectangular tube will not damage the inner walls (for example, a sealing surface to be brought into close contact with a waterproof rubber plug in the case of a watertight connector, a resin lock provided along the inner wall of the cavity to lock the male terminal fitting) of the cavity during insertion of the male terminal fitting.

Rear edges of inner and outer plates preferably are aligned and function as a securing portion. The male terminal fitting is locked at the proper insertion position by the engagement of a lock in the cavity with the securing portion. Thus, a larger area of engagement can be attained as compared to a case where the lock is engaged with a portion formed by cutting a single plate.

The invention also relates to a connector with at least one male terminal fitting as described above. The male terminal fitting is insertable in an inserting direction into a cavity in a housing of the connector. The housing has a receiving surface arranged substantially normal to the inserting direction of the male terminal fitting in the cavity. Thus, the male terminal fitting is stopped at the specified proper insertion position by contact of the contact surface with the receiving surface and the male terminal fitting will not move further forward.

At least one deformation permitting space preferably is formed in the housing for permitting resilient deformation of a lock in the housing. The lock comprises at least one thin portion formed by partially cutting a surface of the lock that faces the deformation permitting space. The lock also comprises a thick portion that is thicker than the thin portion.

The housing preferably has a plurality of cavities and locks are provided in the respective cavities for engaging and locking the terminal fittings. Some locks form at least parts of partition walls between adjacent cavities.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
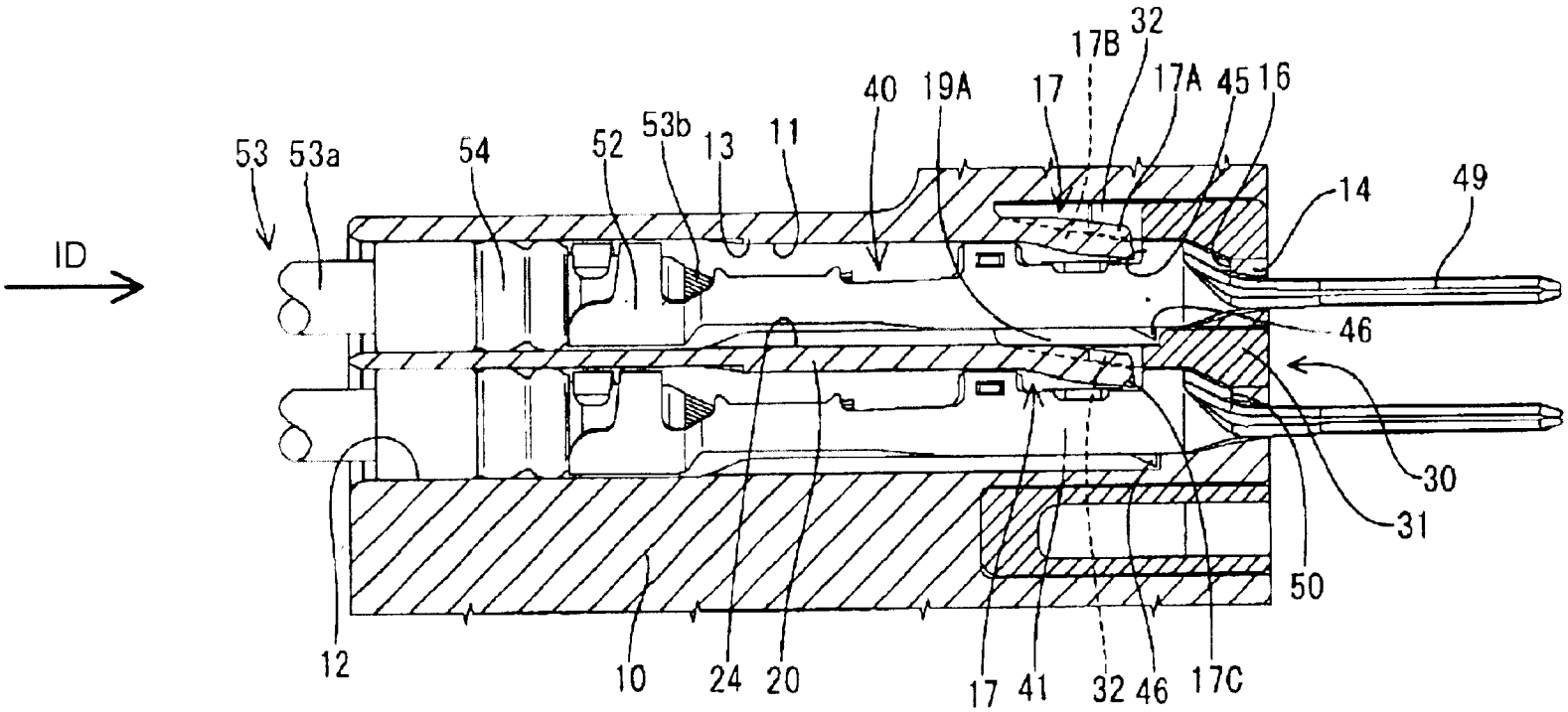
FIG. 1 is a section of an assembled connector according to the invention.
Figure 2:
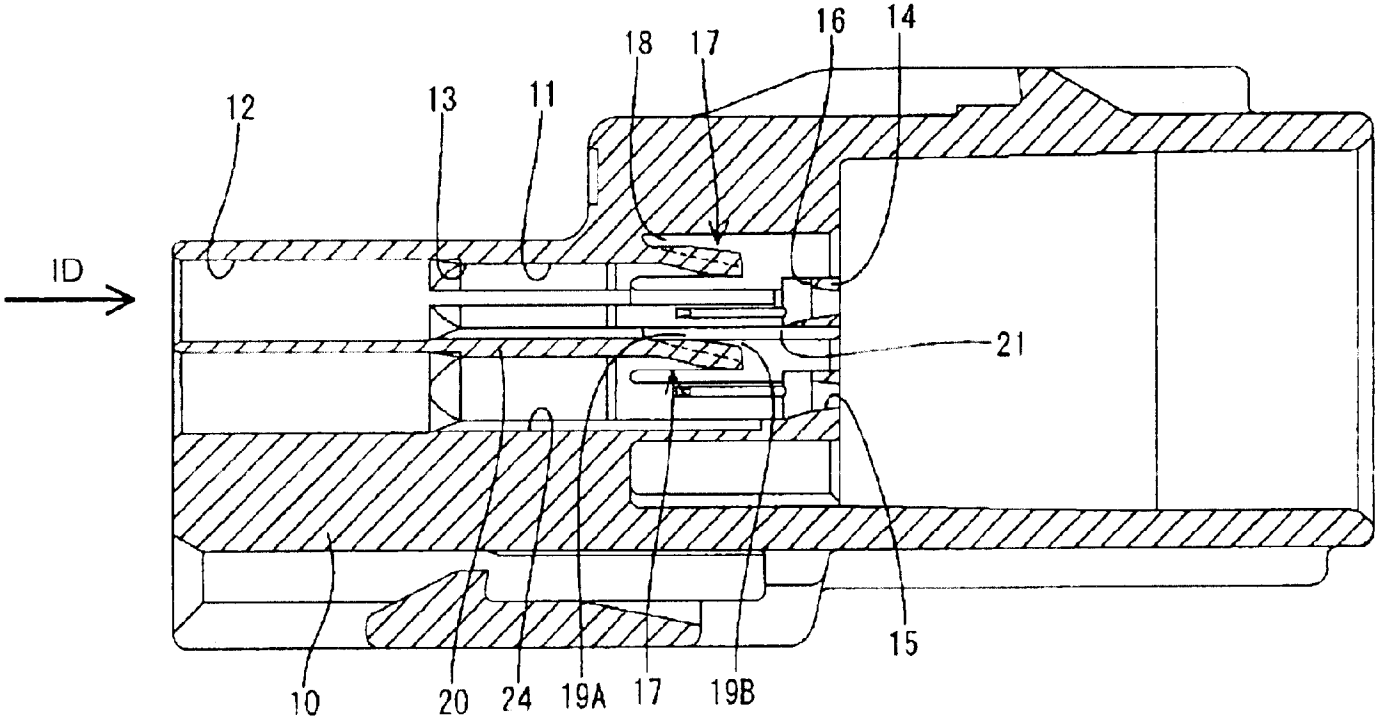
FIG. 2 is a section of a housing.
Figure 3:
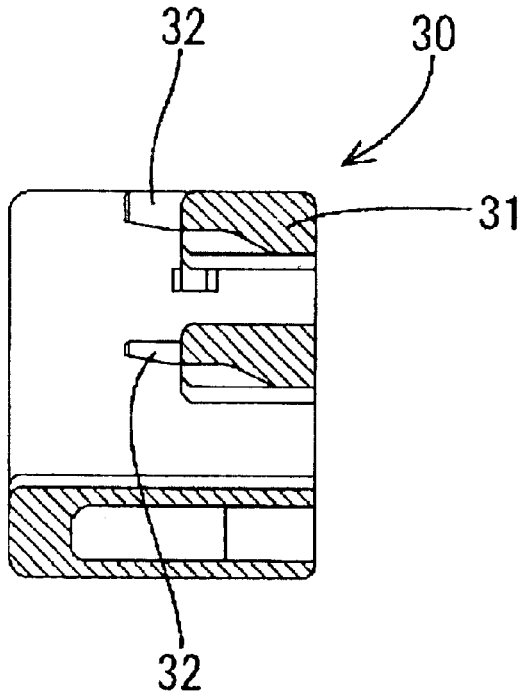
FIG. 3 is a section of a front retainer.

A connector according to the invention has a housing identified by the numeral 10 in FIGS. 1 to 10. The housing 10 is formed e.g. of a synthetic resin and has cavities 11 that open at opposite front and rear ends of the housing 10. The cavities 11 are arranged substantially side by side at upper and lower stages. A substantially round sealing surface 12 is defined on the inner periphery of the rear end of each cavity 11. A portion of each cavity 11 before the sealing surface 12 has a substantially rectangular cross section, and a step-shaped receiving portion 13 is formed on the ceiling before the sealing surface 12. The receiving portion 13 is more backward than the longitudinal center of the cavity 11.

A front wall 14 stands up from the front end of the bottom wall of the cavity 11 and has an opening 15 for receiving a tab of a male terminal fitting. A substantially flat receiving surface 16 projects from the rear of the front wall 14 above the opening 15 and is aligned substantially normal to an inserting direction ID into the cavity 11.

A transversely symmetrical lock 17 is cantilevered forward from a front portion of the ceiling wall of each cavity 11. Each lock 17 has a thick middle 17A with a relatively large vertical dimension and thin sides 17B with relatively small vertical dimensions. Lower surfaces of the thick and thin portions 17A, 17B face into the respective cavity 11 and are substantially continuous and flush with each other. However, the thick middle 17A projects up beyond the thin sides 17B at the upper surface of the lock 17. Accordingly, the lock 17 has a substantially triangular or convex shape when seen in cross-section, and the thick middle 17A defines an apex. The front bottom edge of the lock 17 defines a locking section 17C for engaging a terminal fitting.

Each cavity 11 at the upper stage has a deformation permitting space 18 that opens to the front end of the housing 10. Each cavity 11 at the lower stage has deformation permitting spaces 19A, 19B that correspond respectively to the thick middle 17A and the thin sides 17B of the respective lock 17. The deformation permitting space 19A for the thick middle 17A vertically penetrates the widthwise center of a partition wall 20 between the upper and lower cavities 11 and provides communication between the upper and lower cavities 11. Thus, the upper surface of the thick middle 17A of each lock 17 in the lower stage directly faces the cavity 11 at the upper stage. The deformation permitting spaces 19B for the thin sides 17B cut partially into the opposite sides of the bottom of the partition wall 20 to define left and right excessive deformation preventing portions 21 that contact the thin sides 17B and prevent deformation of the lock 17 beyond its resiliency limit. The deformation permitting spaces 19A, 19B for the lower stage cavities 11 also open to the front of the housing 10.

The connector also includes a front retainer 30 made e.g. of a synthetic resin. The front retainer 30 has fittable portions 31 that fit into mold removal spaces formed in the front of the housing 10 during the molding of the locks 17 and the deformation permitting spaces 18, 19A, 19B. Deformation preventing portions 32 project from the fittable portions 31 and into the respective deformation permitting spaces 18, 19B for preventing deformation of the locks 17 into the deformation permitting spaces 18, 19A, 19B. Left and right deformation preventing portions 32 are provided for each lock 17 and correspond to the two thin portions 17B of each lock 17.

The deformation preventing portions 32 that fit into the deformation permitting spaces 18 at the upper stage contact the upper surfaces of the thin sides 17B and the ceiling surfaces of the deformation permitting spaces 18 to prevent deformation of the locks 17. The deformation preventing portions 32 that fit into the deformation permitting spaces 19B at the lower stage contact the upper surfaces of the thin sides 17B and the excessive deformation preventing portions 21 on the lower surfaces of the partition walls 20 to prevent deformation of the locks 17. In this way, the deformation preventing portions 32 are inserted into recessed spaces formed by a difference in the thickness of the thick middle 17A and thin sides 17B of the locks 17.

The connector further includes terminal fittings 40. Each terminal fitting 40 is narrow and long in forward and backward directions and is formed by bending, embossing and/or folding a metallic plate material stamped or cut into a specified shape. A longitudinal middle portion of the terminal fitting 40 is formed into a substantially rectangular tube 41 with first and second side plates that stand up at the opposite lateral edges of a bottom plate. Front and rear inner plates 42F, 42R extend in from the front and rear ends of the upper edge of first side plate, and front and rear outer plates 43F, 43R extend in from the front and rear ends of the upper edge of the second side plate. For simplicity, the inner and outer plates are referred to collectively herein by the numerals 42 and 43 respectively. The outer plates 43 are placed on the upper or outer surfaces of the inner side plates 42. A receiving plate 44 extends in from a substantially middle part of the upper edge of the first side plate between the two inner plates 42 and is engaged with the upper end of the second side plate. The rear ends of the front inner and outer plates 42 and 43 are substantially vertically continuous and flush with each other to define a securing portion 45.

An upside-down insertion preventing portion 46 is formed by making a cut in the bottom plate of the rectangular tube 41 at a substantially widthwise middle position near the front end and bending this cut portion down out. Alternatively, the upside-down insertion preventing portion 46 may be formed by embossing. The front surface of the upside-down insertion preventing portion 46 is substantially normal to the inserting direction ID of the terminal fitting 40 into the cavity 11. The upside-down insertion preventing portion 46 is disposed such that a distance between the front wall 14 of the cavity 11 and the upside-down insertion preventing portion 46 with the terminal fitting 40 inserted to a proper insertion position is less than a distance between the front wall 14 and the front end of the lock 17 (see FIG. 5(*a*)). Thus, the upside-down insertion preventing portion 46 of the terminal fitting 40 inserted into the cavity 11 at the upper stage directly faces the corresponding cavity 11 at the lower stage through the deformation permitting space 19A of the partition wall 20. However, this upside-down insertion preventing portion 46 will not interfere with the lock 17 at the lower stage when the terminal fitting 40 is inserted properly.

A coupling portion 47 is formed at the front of the rectangular tube 41 and tapers toward the front in a substantially pyramidal shape. The bottom plate and the opposite side plates of the coupling portion 47 are substantially continuous with those of the rectangular tube 41, and the upper plate of the coupling portion 47 extends in from the upper edge of one side plate thereof. An overlay plate 48 extends from the front end of the front outer plate 43 of the rectangular tube 41 and slopes moderately down to the front. The overlay plate 48 is placed on the outer surface of the upper plate of the coupling portion 47. The front end of the overlay plate 48 substantially reaches the front end of the coupling portion 47 and a long narrow tab 49 projects forward from the coupling portion 47. The front end of the overlay plate 48 is curved slightly so as to be substantially parallel with the inserting direction ID of the terminal fitting 40 into the cavity 11. A contact surface 50 is defined at the front end of the overlay plate 48 and is substantially normal to the inserting direction ID of the terminal fitting 40 into the cavity 11.

The tab 49 is formed by vertically folding a plate piece extending forward from the upper and lower plates and one side plate of the coupling portion 47 into a U-shape, such that upper and lower parts of the folded plate face each other. Thus, the tab 49 is connectable with an unillustrated mating female terminal fitting. A wire connecting portion 52 extends from the rear end of the rectangular tube 41. The wire connecting portion 52 is in the form of an open barrel formed by bending or folding pieces that stand up from the opposite lateral edges of a bottom plate. The wire connecting portion 52 is crimped, bent or folded into connection with an insulation coating 53*a* and a core 53*b* of a wire 53. A watertight rubber plug 54 is mounted on the wire 53 behind the wire connecting portion 52 and is insertable into the housing 10 for contact with the sealing surface 12.

Figure 4:
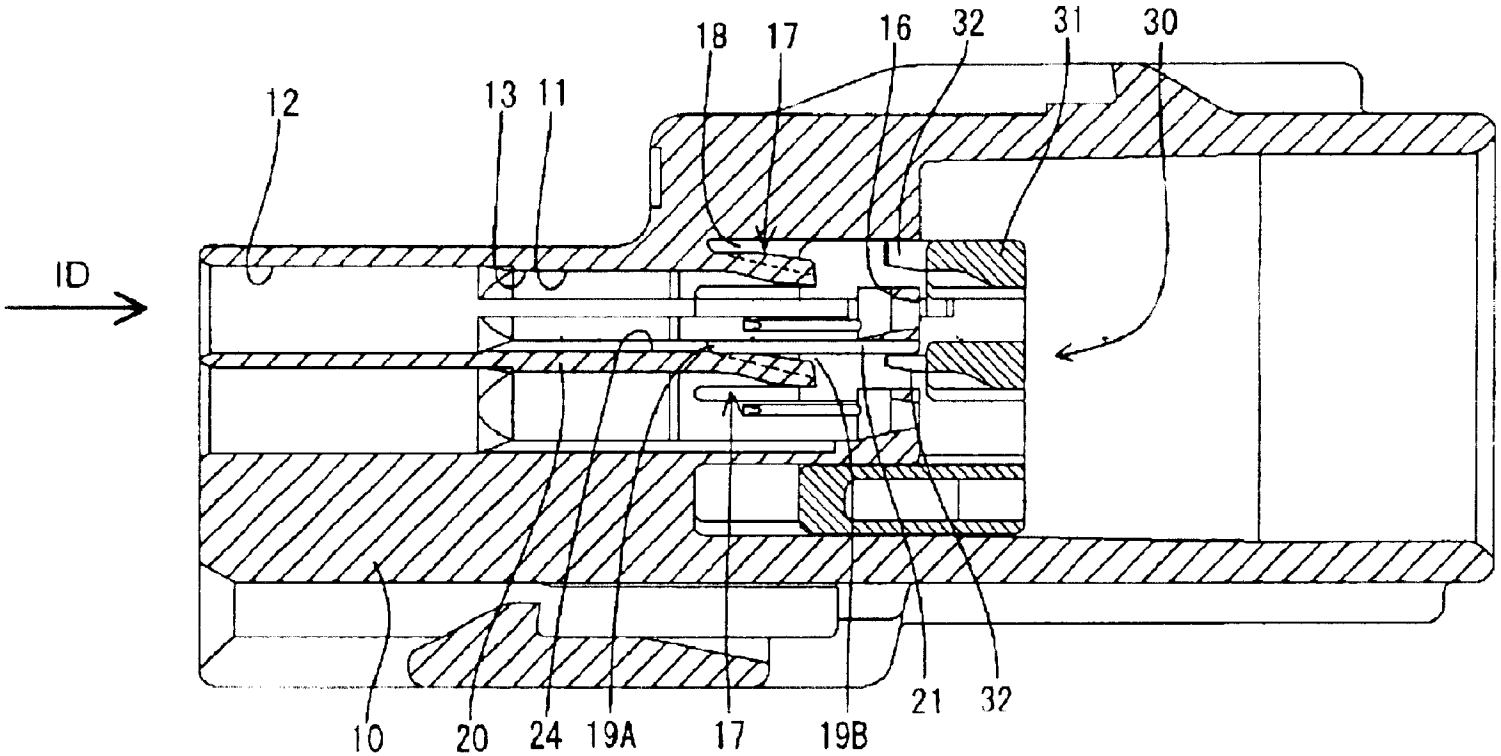
FIG. 4 is a section showing a state where the front retainer is held at a partial locking position in the housing.
Figure 5:
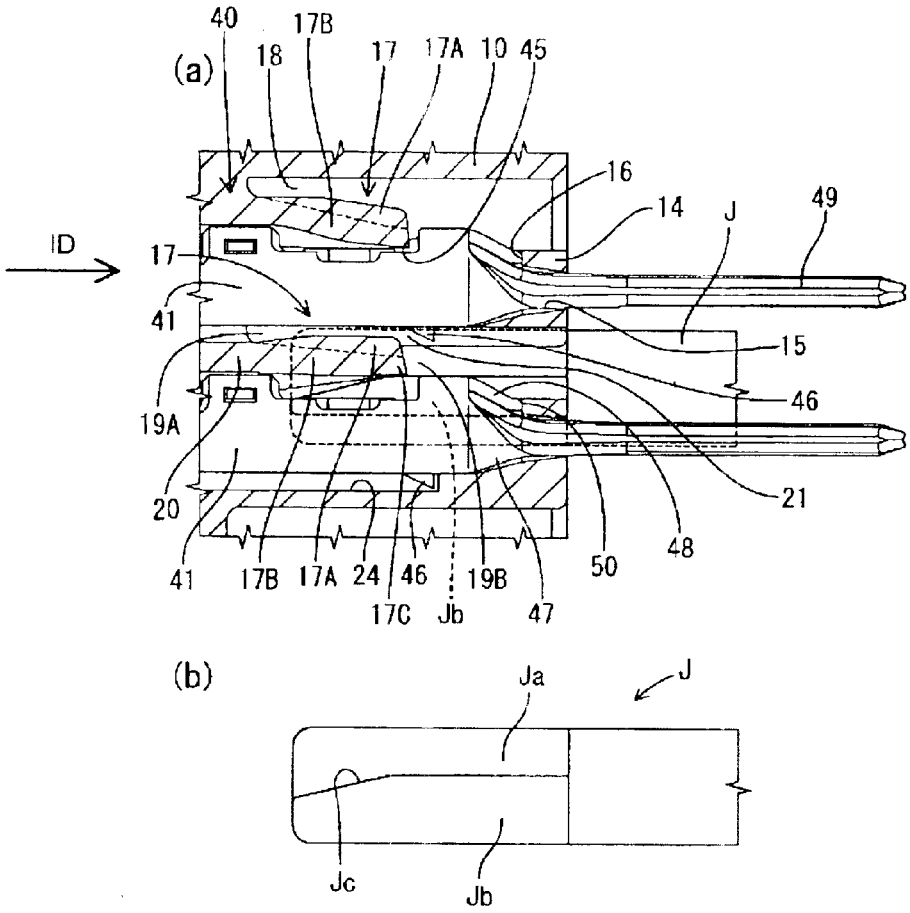
FIGS. 5(*a*) and 5(*b*) are a section showing a state where a lock is resiliently deformed by a withdrawing jig to free a terminal fitting from its locked state, and a side view of the withdrawing jig, respectively.

The connector of this embodiment is assembled by first mounting the front retainer 30 at a partial locking position in the housing 10. The deformation preventing portions 32 are spaced forward from the front ends of the locks 17, as shown in FIG. 4, when the front retainer 30 is at the partial locking position. Thus, the locks 17 can deform toward the deformation permitting spaces 18, 19A, 19B. Each terminal fitting 40 then is inserted in the inserting direction ID into the corresponding cavity 11. The front end of the upper surface of the rectangular tube 41 contacts the lower surface of the lock 17 when the terminal fitting 40 nears the proper insertion position. Thus, the lock 17 resiliently deforms up away from the terminal fitting 40 and into the deformation permitting space 18 or 19A, 19B. The front end of the front outer plate 43 of the terminal fitting 40 is smoothly continuous with the overlay plate 48 that extends obliquely down. Accordingly, there is no possibility of damaging the lower surface of the lock 17.

The lock 17 is restored resiliently when the terminal fitting 40 reaches the proper insertion position and the locking section 17C at the front end of the lock 17 engages the securing portion 45 on the upper surface of the rectangular tube 41 from behind. As a result, the terminal fitting 40 is locked and cannot make loose backward movements. Further, the contact surface 50 of the terminal fitting 40 contacts the receiving surface 16 of the cavity 11 to prevent any further forward movement of the terminal fitting 40. Both the contact surface 50 and the receiving surface 16 are substantially normal to the inserting direction ID of the terminal fitting 40 into the cavity 11. Accordingly, the terminal fitting 40 can be held precisely at its front-limit position The upside-down insertion preventing portion 46 projects from the bottom surface of the rectangular tube 41 and moves along the escaping groove 24 in the bottom surface of the cavity 11 during the insertion of the terminal fitting 40. A front end of the escaping groove 24 of each cavity 11 at the upper stage shares the space with the deformation permitting space 19A. The tab 49 projects out of the housing 10 through the opening 15 at the leading end of the cavity 11 when the terminal fitting 40 is inserted properly. The rubber plug 54 is held in close contact with the sealing surface 12 at the rear end of the cavity 11 to prevent the entrance of water into the cavity 11 from behind.

The front retainer 30 is pushed to a full locking position, as shown in FIG. 1, after all of the terminal fittings 40 are inserted. Thus, the deformation preventing portions 32 enter the deformation permitting spaces 18, 19B to face the upper surfaces of the thin sides 17B of the locks 17. Contact of the thin sides 17B with the deformation preventing portions 32 prevent the locks 17 from being deformed toward the deformation permitting spaces 18, 19A, 19B and thus the locks 17 are held while being engaged with the terminal fittings 40. In this way, the terminal fittings 40 are locked doubly and are prevented from coming out.

A terminal fitting 40 might be inserted insufficiently when the front retainer 30 is pushed toward the full locking position. However, the lock 17 deformed by this terminal fitting 40 is still in the deformation permitting space 18, 19B. Thus, the deformation preventing portions 32 contact the lock 17 and the front retainer 30 cannot be pushed any further. Therefore, the presence of the insufficiently inserted terminal fitting 40 can be detected.

Figure 6:
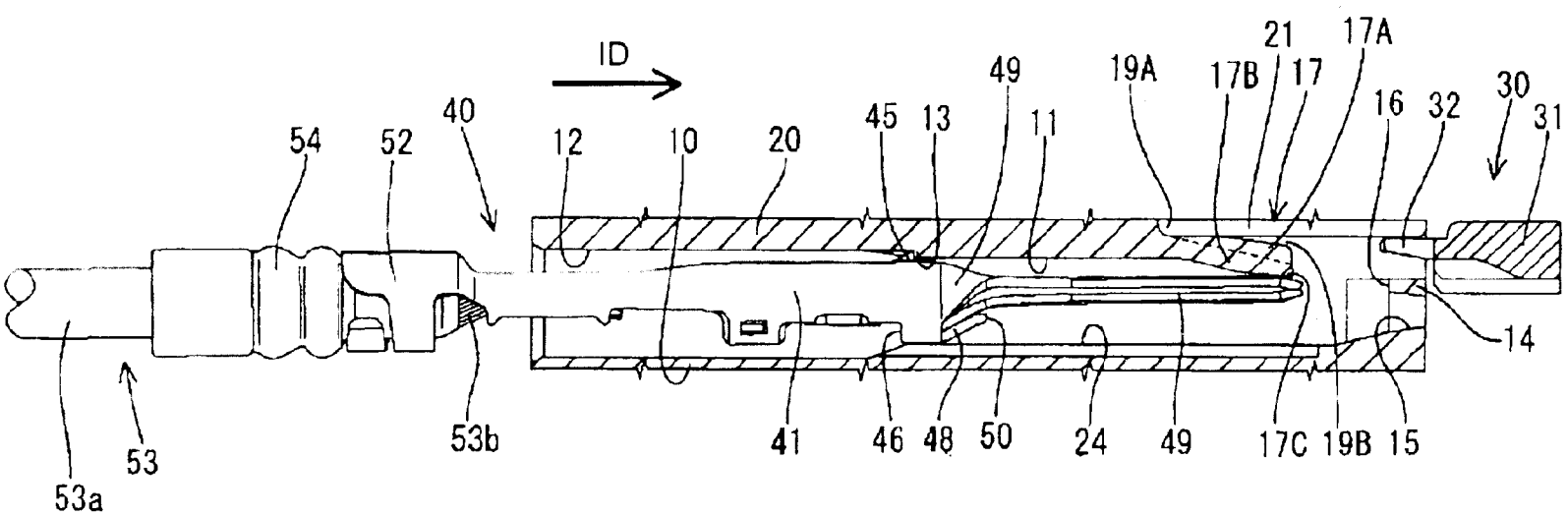
FIG. 6 is a section showing a state where the terminal fitting is inserted upside down.
Figure 7:
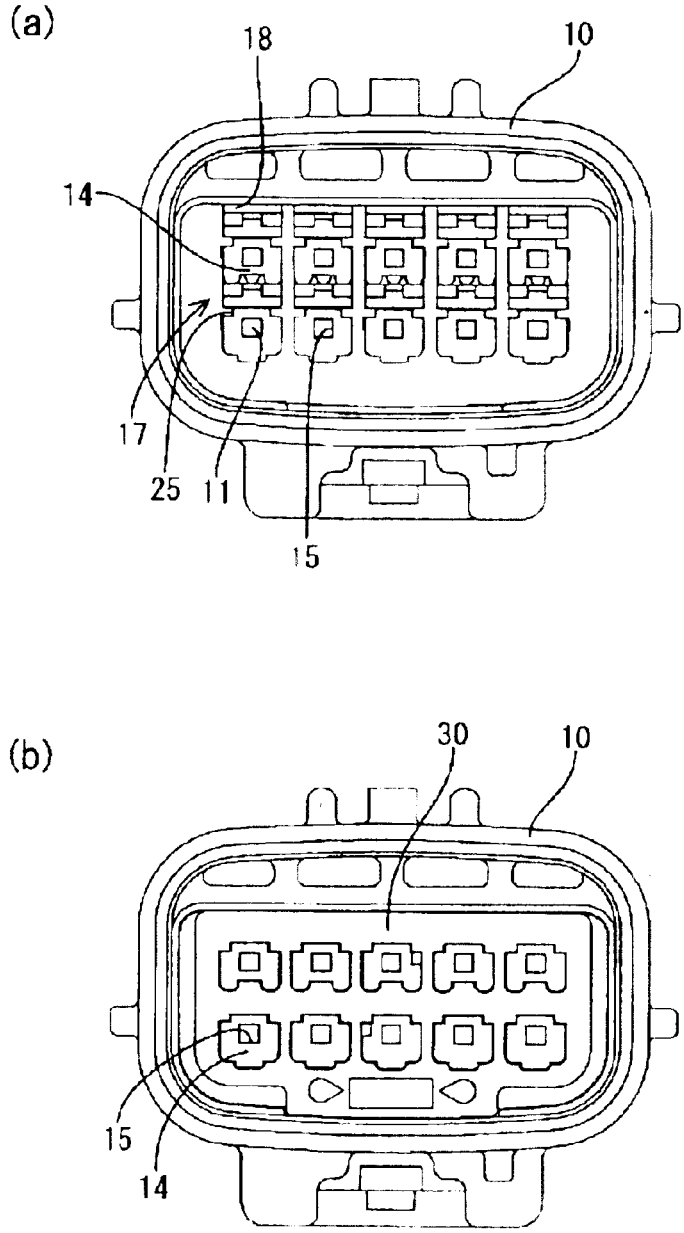
FIGS. 7(*a*) and 7(*b*) are a front view of only the housing, and a front view of the housing having the front retainer mounted therein, respectively.

An attempt might be made to insert a terminal fitting 40 upside down. However, the upside-down insertion preventing portion 46 of the terminal fitting 40 engages the receiving portion 13 of the cavity 11 from behind, as shown in FIG. 6, and further insertion of the terminal fitting 40 is hindered. An operator can notice that the terminal fitting 40 is held upside down by this hindrance to the inserting operation. The front end of the tab 49 cannot reach the front wall 14 of the cavity 11 if the insertion is hindered in this way because the distance between the front wall 14 of the cavity 11 and the receiving portion 13 exceeds the distance between the upside-down insertion preventing portion 46 and the leading end of the tab 49.

Figure 8:
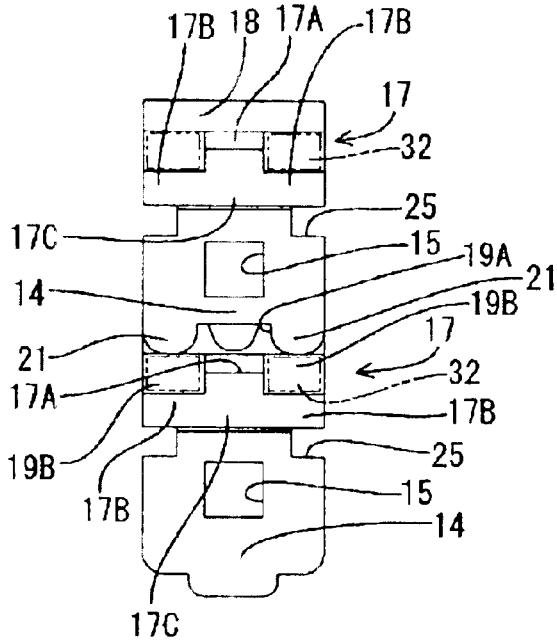
FIG. 8 is a partial enlarged front view of the housing.
Figure 9:
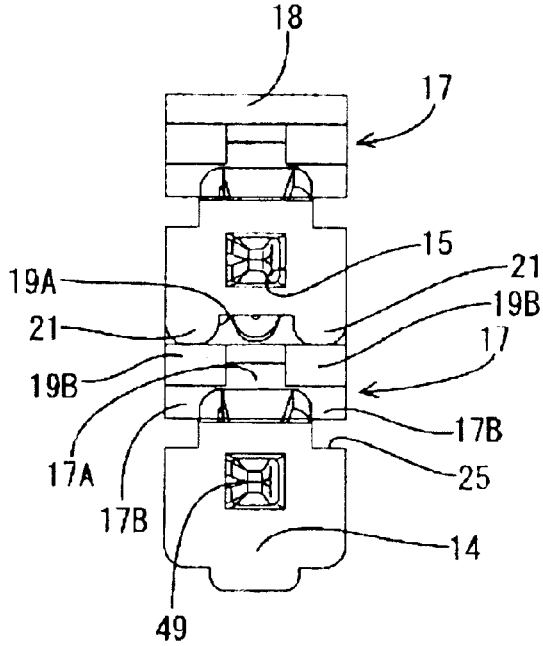
FIG. 9 is a partial enlarged front view of the housing with the terminal fittings inserted.
Figure 10:
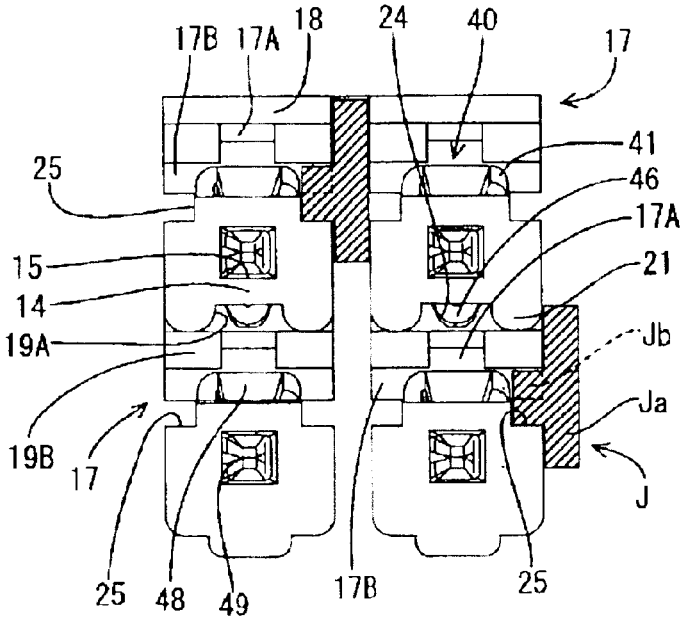
FIG. 10 is a partial front view showing a positional relationship between the locks and the withdrawing jigs.
Figure 11:
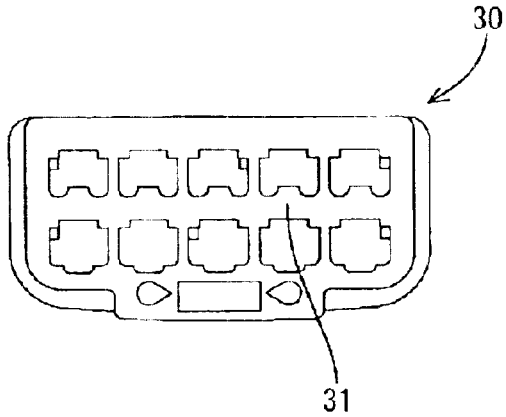
FIG. 11 is a front view of the front retainer.
Figure 12:
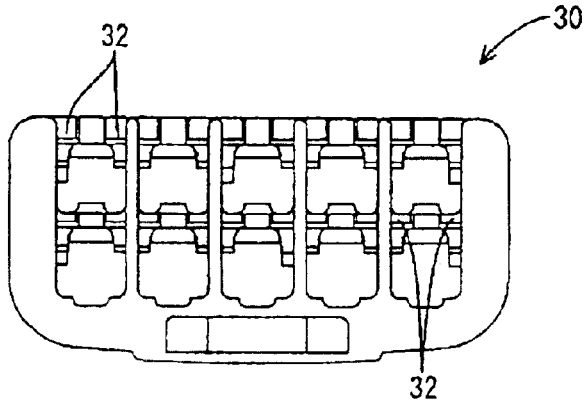
FIG. 12 is a rear view of the front retainer.
Figure 13:
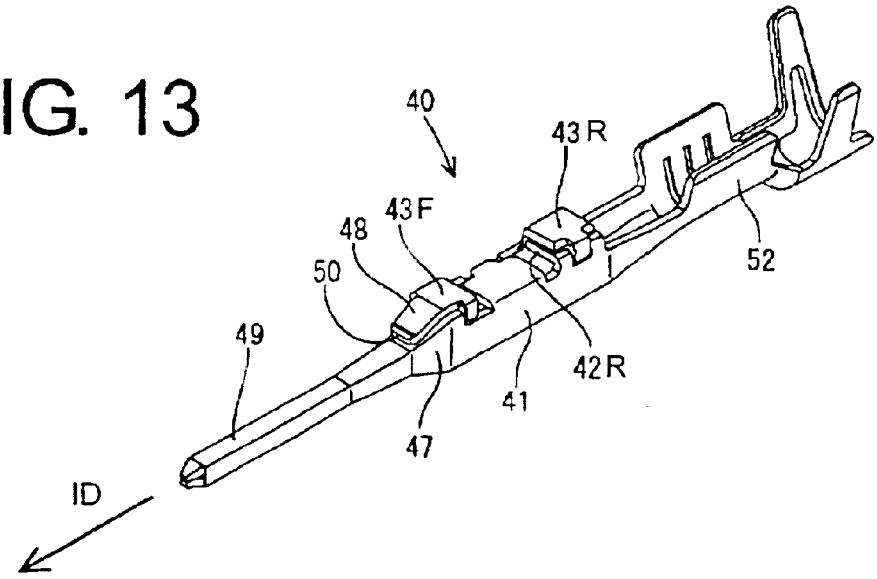
FIG. 13 is a perspective view of the terminal fitting.
Figure 14:
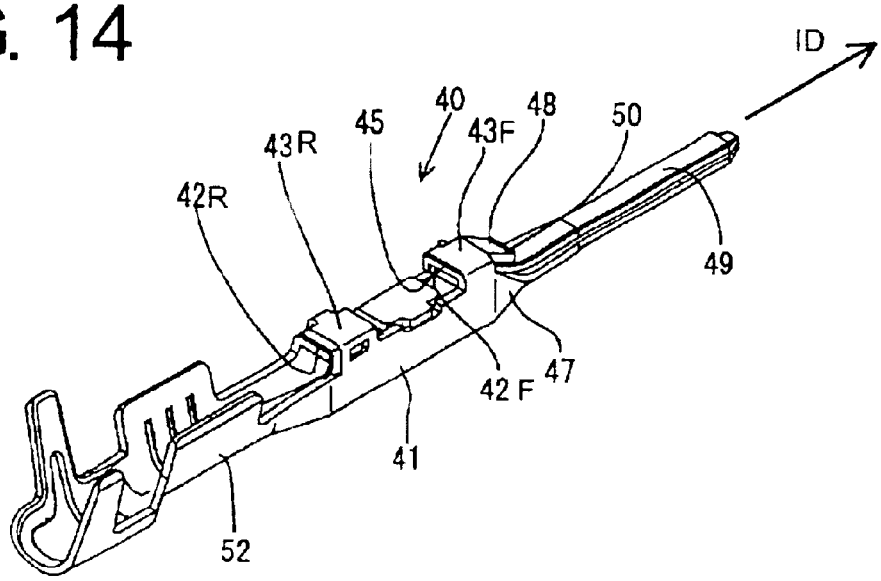
FIG. 14 is a perspective view of the terminal fitting.
Figure 15:
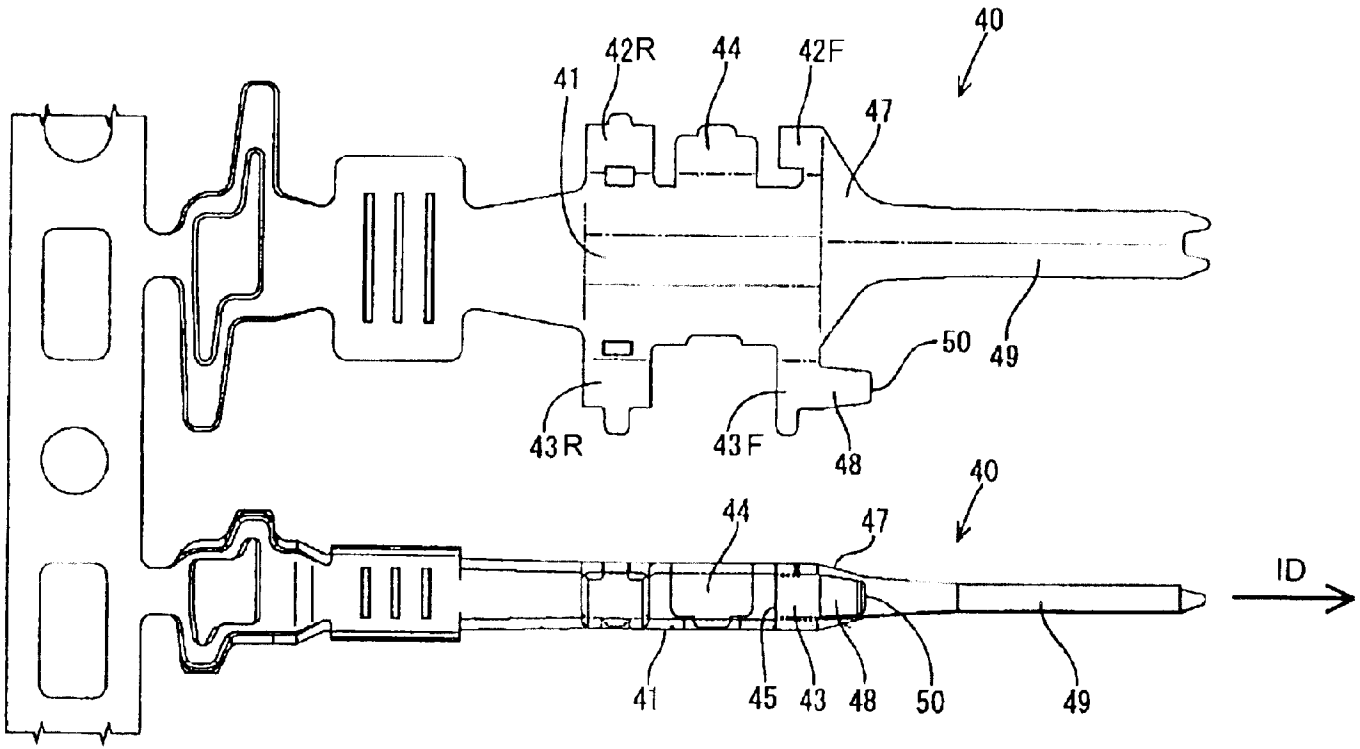
FIG. 15 is a plan view of a manufacturing process of terminal fittings.
Figure 16:
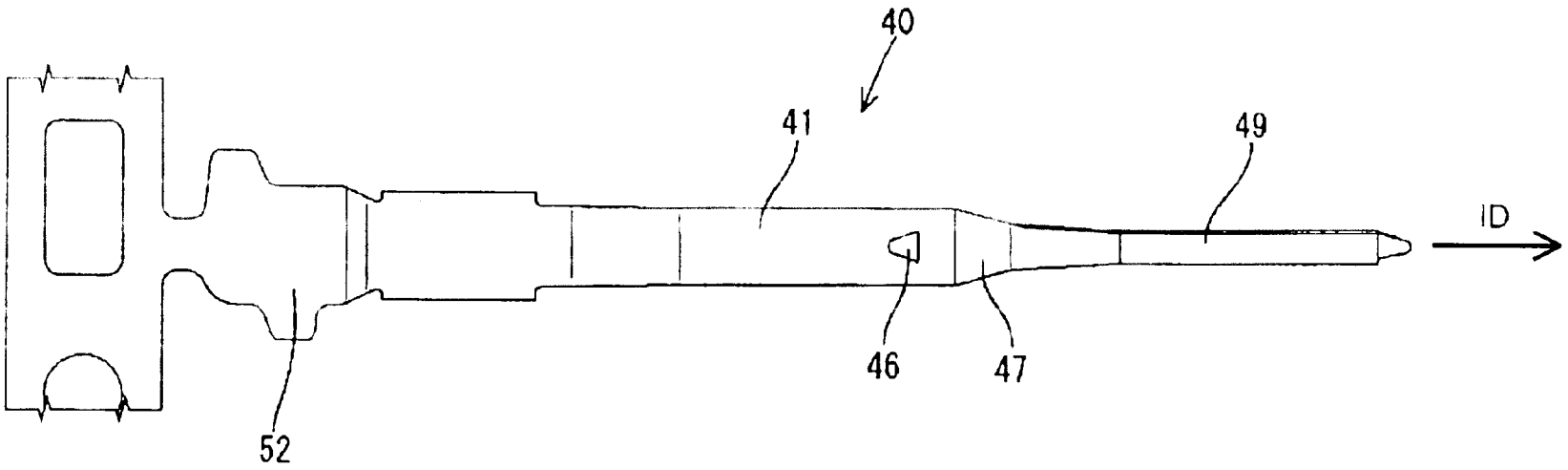
FIG. 16 is a bottom view of the terminal fitting.

The inserted terminal fitting 40 is withdrawn by first detaching the front retainer 30 from the housing 10. A withdrawing jig J then is inserted into the housing 10 from the front. The withdrawing jig J has a long base plate Ja, a pushing portion Jb that projects from a side of the base plate Ja, and a slanted guide surface Jc at the leading end of the pushing portion Jb with respect to an inserting direction of the withdrawing jig J into the housing 10. The locks 17 are wider than the terminal fittings 40 so that the thin sides 17B of the locks 17 project laterally beyond the terminal fittings 40, as shown in FIGS. 8 to 10. The upper ends of the side walls of the cavities 11 are cut to be lower than the upper surfaces of the thin sides 17B of the locks. Additionally, withdrawal spaces 25 are defined between the upper ends of the side walls and the lower surfaces of the thin sides 17B and open at the front end surface of the housing 10. The pushing portion Jb can be inserted into the withdrawal space 25 so that the guide surface Jc contacts the lower surface of the thin side 17B. Thus, the lock 17 is deformed up by the inclination of the guide surface Jc to disengage the locking section 17C at the front end of the lock 17 from the securing portion 45 of the terminal fitting 40 as the withdrawing jig J is inserted further. In this way, the terminal fitting 40 is freed from its locked state, and the terminal fitting 40 can be withdrawn from the cavity 11 by pulling on the wire 53.

The male terminal fitting 40 is inserted into the cavity 11 in the inserting direction ID and is stopped at its front-limit position by bringing the contact surface 50 thereof into contact with the receiving surface 16 in the cavity 11. Thus, the male terminal fitting 40 can be stopped securely at the specified proper insertion position and will not move further forward in the inserting direction ID. More particularly, the contact surface 50 is oriented in the same direction or substantially parallels the receiving surface 16 and interacts with the contact surface 50 substantially in the inserting direction ID so that a loose movement can be prevented, while advantageously ensuring the proper insertion position of the male terminal fitting 40.

The coupling portion 47 of the terminal fitting 40 is formed with a press that deforms the front end of the rectangular tube 41 into a tapered shape, and hence the coupling portion 47 is potentially weak. However, the coupling portion 47 is reinforced by the overlay plate 48 and is not likely to deform.

The outer edge of the contact surface 50 of the terminal fitting 40 is a sharp edge, but is more inward than the outer surface of the rectangular tube 41 since the contact surface 50 is at the front end of the tapered coupling portion 47. Accordingly, the outer edge of the contact surface 50 does not damage the inner walls (sealing surface 12 to be brought substantially into close contact with the rubber plug 54, locking portion 17 provided along the inner wall of the cavity 11 to lock the male terminal fitting 40, etc.) during the insertion of the male terminal fitting 40.

The front outer plate 43 and the overlay plate 48 of the rectangular tube 41 are made of a single plate, and a boundary between them at the front end of the rectangular tube portion 41 is a relatively smoothly bent surface having no sharp edge. Thus, the front end of the rectangular tube 41 will not damage the inner wall portions of the cavity 11 during the insertion of the male terminal fitting 40.

The lock 17 engages the double-plate portion formed by the inner and outer plates 42, 43 of the rectangular tube 41. Thus, a larger area of engagement can be attained as compared to a case where the lock is engaged with a portion formed by cutting a single plate.

The locks 17 at the lower stage also are part of the partition walls 20 between the vertically adjacent cavities 11 for achieving miniaturization. Additionally, the upside-down insertion preventing portions 46 and the locks 17 are arranged so as not to interfere with each other along the inserting direction ID of the terminal fittings 40. Accordingly, the upside-down insertion preventing portions 46 do not interfere with the vertically adjacent locks 17 at the lower stage even though both the upside-down insertion preventing portions 46 and the locks 17 are near the front end and are on opposite sides. Therefore, insertion resistance can be reduced and early detection of an upside-down insertion can be realized by causing the locks 17 to serve as the partition walls 20 between the vertically adjacent cavities 11 for the miniaturization of the connector and enabling both the upside-down insertion preventing portions 46 and the locks 17 to be near the front.

The front end of the tab 49 has not yet reached the front wall 14 when any further insertion of an upside down terminal fitting 40 is prevented by contact of the upside-down insertion preventing portion 46 with the receiving portion 13. Thus, the tab 49 will not strike against the front wall 14 and be deformed.

Each lock 17 has the thin sides 17B and each partition wall 20 between vertically adjacent cavities 11 has the excessive deformation preventing portions 21. Thus, excessive deformation of the lock 17 beyond its resiliency limit can be prevented, while the desired resilient deformation of the lock 17 is permitted.

Each lock 17 has the thick middle 17A and the thin sides 17B formed by partially cutting the upper surface of the lock 17 facing the deformation permitting spaces 18, 19A, 19B along a widthwise direction. The deformation preventing portions 32 are inserted into the spaces formed by the difference in thickness between the thick middle 17A and the thin sides 17B and contact the upper surfaces of the thin sides 17B to prevent deformation of the lock 17. Thus, the locks 17 and the deformation preventing portions 32 overlap along thickness direction, which is the deformation direction of the lock 17, and the connector can be made smaller due to overlapping thickness.

Each lock 17 is thinned over part of the entire width, and therefore a sufficient strength is secured for the entire lock 17. Further, the deformation permitting spaces 19B corresponding to the thin sides 17B have a large height, and the thickness of the deformation preventing portions 32 that contact the thin sides 17B can be made larger so that a sufficient strength can be secured for the deformation preventing portions 32.

The deformation permitting space 19A for the thick middle 17A is formed by partially cutting a center portion of each partition wall 20 between the vertically adjacent cavities 11. Additionally, the deformation preventing portions 32 fit into the deformation permitting spaces 19B between the thin sides 17B and the partition wall 20 that separates vertically adjacent cavities 11. Thus, the deformation permitting spaces 19A for the thick middles 17A of the locks 17 at the lower stage and the partition walls 20 between the vertically adjacent cavities 11 overlap along the vertical direction, which is the deflection direction of the lock 17. Therefore, the connector can be made shorter by this overlapping thickness.

The thick middle 17A of each lock 17 projects more toward the deformation permitting space than the thin sides 17B. Thus, a degree of the resilient deformation of the lock 17 is restricted. However, the deformation permitting space 19A for the thick middle 17A is formed in the partition wall 20 between the vertically adjacent cavities 11. Thus, the degree of the resilient deformation of the lock 17 can be larger, and an area of engagement of the lock 17 and the terminal fitting 40 is increased to lock the terminal fitting 40 with improved reliability.

The deformation permitting space 19A for the thick middle 17A of the locks 17 in the lower stage communicates with the cavities 11 above the partition wall 20. Thus, the lock 17 can be deformed more than with a deformation permitting space formed merely by a groove in a partition wall. The deformation of the lock 17 cannot be restricted by the contact of the thick middle 17A of the lock 17 with the partition wall 20 because the deformation permitting space 19A communicates with the vertically adjacent cavities 11. However, the excessive deformation preventing portions 21 are provided in the areas of the partition wall 20 corresponding to the thin sides 17B. Therefore, the lock 17 is prevented from excessive deformation.

The lock 17 is substantially transversely symmetrical. Thus, the rigidity of the lock 17 also is transversely symmetrical, and the lock 17 is not displaced to the left or right side when being deformed during insertion of the terminal fitting 40.

The invention is not limited to the above described and illustrated embodiment. For example, the following embodiments are also embraced by the technical scope of the present invention as defined in the claims. Beside the following embodiments, various changes can be made without departing from the scope and spirit of the present invention as defined in the claims.

Although the receiving surface is provided at the tapered coupling portion in the foregoing embodiment, it may be provided on the outer surface of the substantially rectangular tube.

Although the receiving surface is provided at the front end of the coupling portion in the foregoing embodiment, it may be provided at an intermediate position of the inclined coupling portion.

What is claimed is:

1. A male terminal fitting having opposite front and rear ends, an elongate tab adjacent the front end and defining a longitudinal direction and a selected cross-section normal to the longitudinal direction, a substantially rectangular tube spaced rearward of the tab and defining a cross-section larger than the tab, at least part of a wall of the substantially rectangular tube having an inner plate and an outer plate placed over the inner, a coupling portion extending from the substantially rectangular tube to the tab and converging from a large cross-section adjacent the substantially rectangular tube to a small cross-section adjacent the tab, an overlay plate extending integrally from the outer plate of the rectangular tube and being placed substantially on an outer surface of the coupling portion, a contact surface on an end of the overlay plate and disposed substantially at an end of the coupling portion adjacent the tab and aligned substantially normal to the longitudinal direction of the tab.

2. The male terminal fitting of claim 1, wherein the outer and inner plates have substantially aligned rear edges defining a securing portion.

3. The male terminal fitting of claim 1, further comprising an improper insertion preventing portion projecting from the substantially rectangular tube.

4. A connector, comprising:

a housing (10) having opposite front and rear ends, cavities extending through the housing and defining an inserting direction extending between the front and rear ends, a rearwardly facing receiving surface formed in each said cavity and aligned substantially normal to the inserting direction; and male terminal fittings inserted into the respective cavities along the inserting direction, each said male terminal fitting having opposite front and rear ends, a tab at the front end, a substantially rectangular tube spaced rearward of the tab and defining a cross section larger than the tab, at least part of a wall of the substantially rectangular tube having an inner plate and an outer plate placed over the inner plate, a coupling portion extending from the substantially rectangular tube to the tab and converging from a large cross-section adjacent the substantially rectangular tube to a small cross-section adjacent the tab, an overlay plate extending integrally from the outer plate of the substantially rectangular tube and placed substantially on an outer surface of the coupling portion, a contact surface on an end of the overlay plate and substantially at an end of the coupling portion adjacent the tab, the contact surface being aligned substantially normal to the inserting direction and engaged against the receiving surface of the respective cavity.

5. The connector of claim 4, wherein the outer and inner plates have substantially aligned rear edges defining a securing portion, the housing being formed with locks engaging the securing portions.

6. The connector of claim 5, further comprising an improper insertion preventing portion projecting from the substantially rectangular tube and engaged in a groove formed in the respective cavity.

7. The connector of claim 5, wherein at least one deformation permitting space is formed in the housing for permitting resilient deformation of the lock, wherein the lock comprises at least one thin portion formed by partially cutting a surface of the lock facing the deformation permitting space, and a thick portion thicker than the thin portion.

8. The connector of claim 5, wherein some locks form at least parts of partition walls between adjacent cavities.

* * * * *